US005222616A

United States Patent [19]

Druesne et al.

[11] Patent Number: 5,222,616

[45] Date of Patent: Jun. 29, 1993

[54] METAL SEALING OR CLOSURE CAP WITH TEAR LINE

[75] Inventors: Guy Druesne, La Fleche; Joel Michaud, Montpon Menestrol, both of France

[73] Assignee: Pechiney Emballage Alimentaire, Clichy, France

[21] Appl. No.: 779,261

[22] Filed: Oct. 18, 1991

[30] Foreign Application Priority Data

Dec. 5, 1990 [FR] France ..... 90 15454

[51] Int. Cl.[5] ..... B65D 41/32

[52] U.S. Cl. ..... 215/256; 215/254; 220/276

[58] Field of Search ..... 215/254, 256; 220/266, 220/276

[56] References Cited

U.S. PATENT DOCUMENTS 1,712,102 5/1929 Carvalho ..... 215/256
1,881,529 10/1932 Hammer ..... 215/256
4,391,383 7/1983 Babiol ..... 215/256
5,012,942 5/1991 Druesne et al. .

*Primary Examiner*—Gary E. Elkins
*Assistant Examiner*—Paul A. Schwarz
*Attorney, Agent, or Firm*—Dennison, Meserole, Pollack & Scheiner

[57] ABSTRACT

The invention relates to a metal cap, the thickness of the skirt of which is 0.06 to 0.4 mm, with at least one tearing ling which includes a cut or tear line and alternating transverse reliefs and external recesses, each recess ending in the tearing line or at least within 0.5 mm thereof, the thickness of the bottom wall of the tear line being 20 to 70% of the thickness of the skirt, and the tearing line having a bottom thickness which is at most equal to 70% of the thickness of the skirt. The invention also relates to a method of producing the cap. The invention is applicable to obtaining tearable tabs for metal caps which tabs tear entirely along the rear line provided without dangerous edges.

11 Claims, 3 Drawing Sheets

METAL SEALING OR CLOSURE CAP WITH TEAR LINE

The invention relates to a metal sealing or closure cap with a tear line or tearable tab for improved tearing.

From our Patent Application EP-A-0360703, a metal cap of aluminum or alloy or tinned iron is known, the skirt of which includes at least one annular tear line or even two lines forming the edges of a tearable tab, each line including a notched or cut line located on its inner face and a succession of reliefs and and transverse recesses located on its outer face vertically of said cut. Tearing of the cap along these tearing lines produces torn edges without rough places that can cause injury.

Nevertheless, experience has shown the present applicant that when narrow tearing strips are involved, the width of which is typically less than 8 mm, and/or with caps of semi-hard or less hard aluminum alloy, the tears often depart from the thus-prepared tearing lines, giving the stump of the cap that remains on the container an irregular and relatively unattractive appearance and including uncontrolled torn edges that may cut or injure someone.

Such uncontrolled disadvantages greatly affect metal caps with a single tearing line or a tearable tab, regardless of the metal or alloy constituting them. Contrarily, the problems of possible injury by the torn edges increase when a change is made from lead bases to tin bases and then aluminum bases.

The present applicant has sought to overcome such disadvantages, and more particularly to obtain tab tears guided in a reliable manner, preferably with non-injurious torn edges.

SUMMARY OF THE INVENTION

The subject of the invention is a metal sealing or closure cap including a skirt having a thickness between 0.06 and 0.4 mm, this skirt including at least one, typically annular tearing line, this line including a cut and an external succession of reliefs and transverse recesses in alternation, characterized in that one end of each said recess is located in said tearing line or at least within 0.5 mm from this line, the thickness of the bottom or residual portion of the recess being between 20 and 70% of the thickness of the skirt, and that this tearing line includes an external cut with a bottom thickness equal at most to 70% of the thickness of said skirt.

In the particular case of a tearable tab formed by two tearing lines according to the invention, these lines include two said external cuts located between the two said succession of reliefs and recesses and thus defining said tearable tab. Each external cut typically has a bottom thickness of between 30 and 70% of the thickness of the skirt.

It has been found that this disposition surprisingly solves the problem presented. A tear can be produced at the end of the alternating reliefs and recesses when there is no cut, but such a tear easily departs from its initial path and continues randomly along an irregular cut which can often be injurious. By bordering the ends, for each tearing line, of alternating recesses with a likewise external cut, the depth of which is less than that of the recesses, each tear becomes constant along its cut and leaves two torn edges without injurious rough points:

the edge of the portion remaining on the container includes the ends of the alternating reliefs and recesses, and in particular as a result is noninjurious;

the edge of the tab or of the torn portion is no longer injurious, for several probable reasons: flexibility, particularly in the case of a detached tab, slices deformed by the cut followed by the operation of extraction and rupture.

It is then important for the fixed portion of the cap, that is, the part remaining on the container, to carry the transverse reliefs and recesses, the ends of which then lend it a non-cutting torn edge, with certainty. It has been found that a slight spacing between the reliefs and recesses and the cut bordering them is admissible, and then produces a slightly oblique break, allowing the previous effect to continue.

Such a spacing is preferably less than 0.5 mm.

It has also been found that the cut can, without disadvantage to good guidance of the tearing, be less deep than the recesses which reach it or almost reach it. This provision is especially important for good mechanical strength of the cap, especially when the recesses constitute a major weakening, leaving a bottom thickness of 0.05 mm, for example. The difference between the bottom thickness of each cut is thus preferably greater than the bottom thickness of the recesses by from 0.01 to 0.10 mm.

It can also be noted that the tearing of a tab is much easier when the extensions of the alternating reliefs, and recesses respectively bordering each of its two tearing lines intersect in a V-shape, the point of which are oriented in the direction of tearing of the tab, or in other words converge in this tearing direction. A disposition with an opposite orientation produces tearing efforts that are typically twice as high and causes some tearing outside the cut.

The alternating transverse reliefs and recesses are located in a zone 0.4 to 1.5 mm in width on the edge of each tearing line. In the case of a tab, preferably including the above orientation condition, these recesses are inclined by 10° to 30° relative to the longitudinal axis of the cap, in the case of metals or alloys with a hardness $H_B > 30$; the bottom thickness of the recesses decreases toward the tearing line. Hence what is involved is an inclination in the transverse direction of the knurling that facilitates the penetration of the reliefs, and the limitation to 30° makes it possible to prevent the corresponding torn edge from becoming injurious.

In a particular embodiment of the invention, each cut and the corresponding tearing line are made by means of a second succession of alternating transverse reliefs and recesses, the ends of these recesses being interpolated between the ends of the recesses of the first succession, so as to form an external cutting line on the cap.

To make such a cutting line, a cutting knife fixed between a knurled ring is no longer used; instead, two knurled rings with staggered reliefs and recesses are used, with the recesses of one coming to face the reliefs of the other. The same general conditions apply, except for the preferential condition of a difference between the bottom thickness of the cut and the bottom thickness of the recesses, each succession of bottoms of recesses forming part of the cut, in this new embodiment. Aside from the very good guidance of the tearing, two torn edges are then obtained for each tear that are provided with alternating reliefs and recesses, and the edge of a torn tab is even more certainly noninjurious. The preferential condition of orientation of the alternating reliefs and recesses to facilitate tearing of the tab is preferably matched by a particular orientation provision with each tearing line now bordered by two successions of alternating transverse reliefs and recesses; the limits of their respective reliefs and recesses preferably form Vs in the direction of tearing of the tab. The inclinations with respect to the tearing direction are then preferably between 10° and 40°.

The cap of the invention is typically of metal or an alloy of the group embodied by lead or its alloy, tin or its alloy, or aluminum or its alloy.

The caps of aluminum alloys with a Brinell hardness greater than 50 require greater compression force.

The invention also applies to caps of other metals or alloys, such as zinc or tinned sheet iron, and to multilayer caps essentially of metal with at least one layer of plastic material, where each cut has a bottom thickness preferably between 20 and 70% of the metal layer on the inside of the cap.

The subject of the invention is also the method for producing a tearing line of a metal sealing or closure cap with a skirt thickness between 0.06 and 0.4 mm, in which this cap is fitted onto an internal mandrel or tool, and an outer tool or knurling wheel is set into rotation relative to said internal tool, said external tool including at least one knurled ring, each carrying a succession of alternating reliefs and recesses, and in which the cap is compressed between the external tool and the internal tool during this rotation. According to the invention, an annular cutting knife is affixed against each said knurled ring, the cutting end of said knife being at least 0.02 mm less in diameter than the outer diameter of said knurled ring and being within 0.5 mm from said ring, and the compressive force of the outer tool on said fitted-on cap is adjusted so as to obtain, after rotation with compression, minimal thicknesses of the cap of between 20 and 70% of the thickness of said skirt for the recesses produces by said alternating reliefs and for the external cut produced by each said annular knife. The recesses between the reliefs of the knurled rings are clearances, rather than contact surfaces, of the cap during this compression.

In this particular embodiment of the invention, each said annular cutting knife is replaced with a second knurled ring bearing alternating reliefs and recesses that come to be located facing the alternating recesses and reliefs, respectively, of the first said knurled ring, the second ring being fixed against the first, and their junction thus defining an external cut formed by the ends of the recesses produced by said alternating reliefs. This double knurling, producing a very fine cut, leads to improved resistance to the strains of capping, while maintaining very good tearing. This cut may be continuous or discontinuous, when the reliefs of the knurled rings are respectively staggered, or when these reliefs have a width less than the recesses that they leave between them. Discontinuous cuts can be obtained that are well adapted to the metal or alloy of the cap and to its hardness and thickness.

ADVANTAGES OF THE INVENTION

Metal caps are obtained with perfectly certain tearing strips: well-guided tearing, with non-cutting or injurious edges, both for the tab and on the portions remaining on the container.

Easy production, with the reliefs that produce the alternating reliefs and recesses and the cuts all being on the external tool.

Improved behavior in capping in the case of the version with double knurling, making daintier types of capping possible.

EXAMPLE 1 (FIGS. 1-3)

Figure 1:
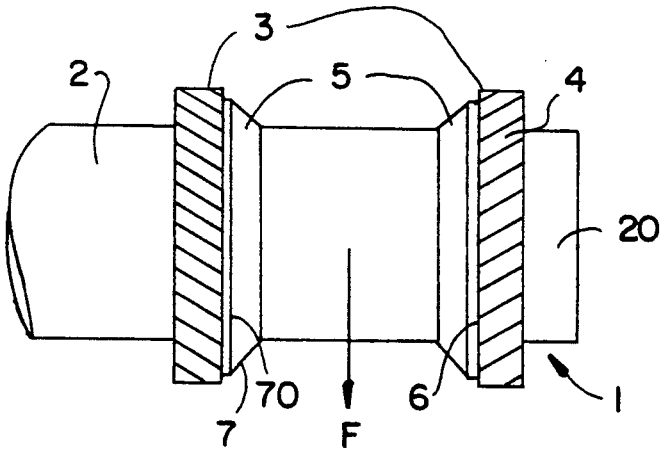
FIG. 1 shows a knurling wheel used to produce a first tearing tab according to the invention, in an elevation view.

FIG. 1 shows a set of knurling wheels 1, arranged about its axis 2 and including two knurling wheels 3 with inclined teeth 4, having an external diameter of 40 mm and a width of 0.7 mm, each knurling wheel 3 including 125 teeth 4 inclined at an angle of 25° with respect to the direction of the axis of symmetry and revolution 20, that is, along the width of the knurling wheel 3. The recesses between teeth have a depth of 0.4 mm, and they do not come into contact with the cap during the knurling.

Two cutting knives 5 are assembled respectively against the inside faces 6 of the knurling wheels and both have a diameter of 39.9 mm, which is slightly less than the outer diameter of the knurling wheels, which makes it possible to keep the bottoms 9 of the cuts slightly thicker than the bottoms 10 of the recesses (FIG. 3), and prevents accidental cuts when the set of knurling wheels is manipulated.

These knives 5 have a width at the base of 0.5 mm and a frustoconical sloping face 7 at 45°, which ends in an edge 70 that is 0.02 mm in width and has a rounded profile.

Figure 2:
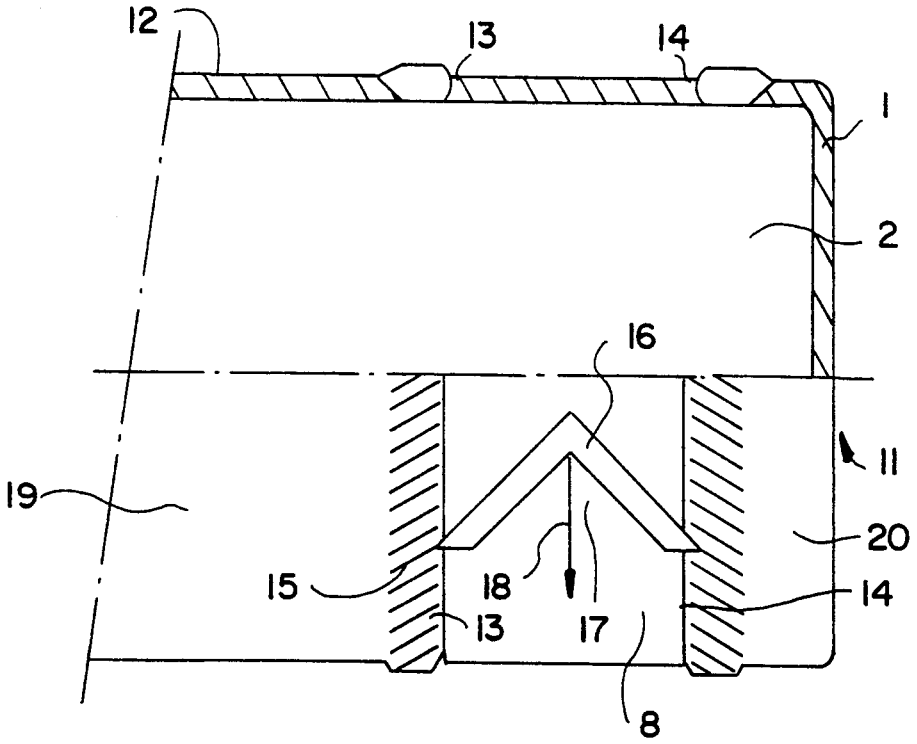
FIG. 2 shows the cap obtained, in an axial half-section taken at the level of the recesses of two knurled zones, and an outer half-view of the cap and its tearing tab.

To prepare for the tearable tab 8 (FIG. 2), the cap 11, which is of slightly alloyed tin containing more than 99% tin and has a skirt thickness of 0.16 mm, is fitted onto a punch (not shown) that is made to rotate at 1380 rpm. This cap 11 has an inside diameter of 29.5 mm at the level of the tearable tab 8 that is to be made. The knurling wheel set 1 is pressed against the skirt 12 of the cap 11 with a force F of 80 daN for 0.16 seconds. Two annular cuts 13 and 14 are thus obtained, having a thickness at the bottom of the cut 9 equal to 0.09 mm, each of them being bordered by a knurled zone the recesses 15 of which have a bottom 10 that is 0.04 mm in thickness. An opening 16 defining a portion 17 for pulling on the tearable tab 8 and defining its tearing direction 18, is then obtained by punching.

More than ten caps 11 prepared in this way were crimped onto bottles and then opened by tearing of their tab 8, all of these tears being made along the cutting or tearing lines 13 and 14, and it is found that the edges of the portions 19 and 20 remaining on the bottle, like the edges of the detached tab 8, did not have any aggressive feature whatever.

Figure 3:
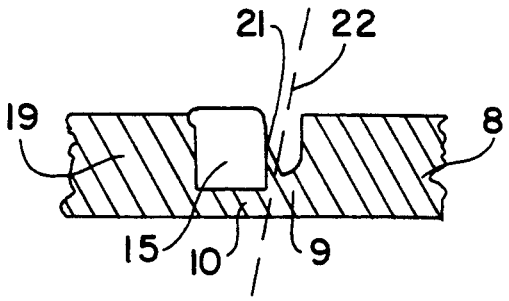
FIG. 3 is a portion in half-section, on the larger scale, at the level of a tearing line.

FIG. 3 shows the situation of the cut 13 with respect to the recesses 15 and reliefs 21 created by the knurling wheel 3. The break is guided perfectly by the cut 13 and has a mean direction 22 with a crenelated edge formed by the reliefs 21 and recesses 15, and a side edge of the tab 8 having an irregular surface.

EXAMPLE 2 (FIG. 4)

With novel caps 110, identical to the caps 11 prior to preparation of their tearable tab 80, the above operations were repeated by inverting the two knurling wheels 3 in such a way that on the completed caps 110, the limits between the reliefs 21 and the recesses 15 bordering each cut 13, 14 converge in the direction 18 of tearing of the tab 80. This is the opposite orientation from that of the first example (FIG. 1), and for more than ten caps thus prepared, one finds a much greater ease of tearing than in Example 1, corresponding to a force estimated to be twice as slight. The limits between reliefs 21 and recesses 15, or long edges of these reliefs 21, are inclined in both examples by an angle of 25° relative to the tearing line 13 or 14.

Figure 5:
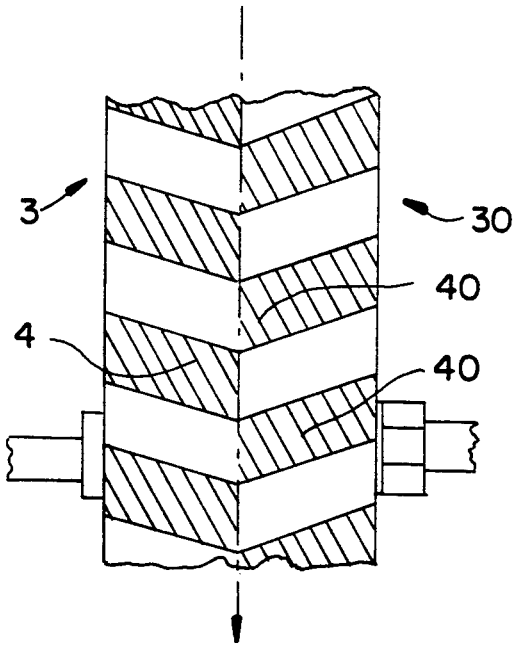
FIG. 5 shows an assembly that is part of an external knurling wheel, in its particular embodiment, for making the invention.
Figure 6:
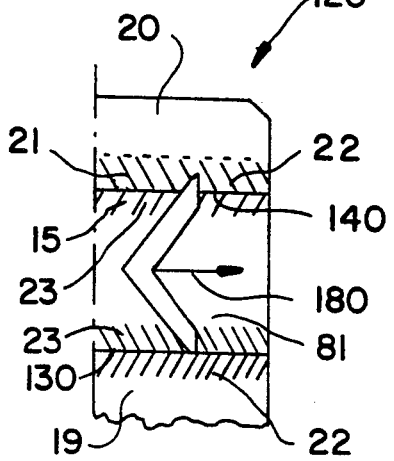
FIG. 6 is an external half-view of a third cap having a tearing tab in accordance with this particular embodiment.

EXAMPLE 3 (FIGS. 5 and 6)

Here caps 120 of the same type were used.

The knife 5 mounted on each serrated knurling wheel 3 is replaced by a second serrated knurling wheel 30, which is inverted and staggered in such a way that at the junction of these two knurling wheels 3 and 30, the end of each transverse relief or tooth 4 is bracketed by and aligned with the ends of two teeth 40 of the mounted knurling wheel 30. The set of knurling wheels then includes two subsets of two such knurling wheels 3 and 30, fixed together in the position described (FIG. 5).

Figure 4:
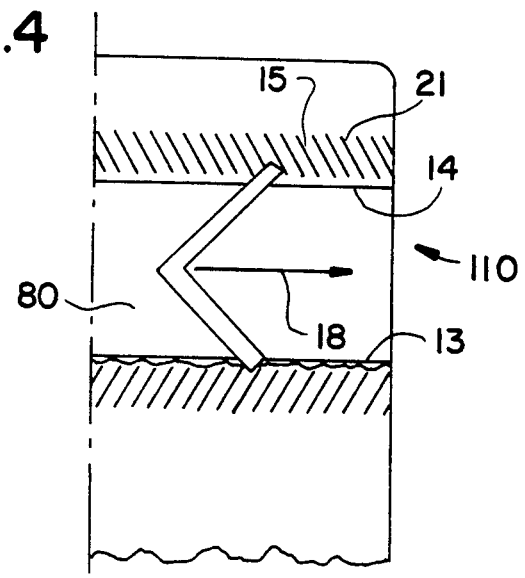
FIG. 4 is an external half-view of a second cap, in which the orientation of the reliefs and recesses of the tearing lines is improved.

The preparation of tearing tabs 81 of this series of more than ten caps 120 was done as before, with the set of knurling wheels thus modified. Two conditions of orientation are observed for facilitating tearing of each tab 81:

- the condition of orientation of Example 2 (FIG. 4) is applied to the reliefs and recesses of knurled zones 22 outside the tab 81, that is, outside the cuts or tearing lines 130 and 140;
- the limits between the reliefs and recesses bordering each tearing line, the relief 21 of each outer zone 22 facing one recess 15 of the knurled zone 23, converge or form Vs with their points oriented in the direction of tearing 180 (FIG. 6).

The cuts 130 and 140 obtained are continuous or discontinuous, depending on whether they were obtained with a set of staggered knurling wheels with reliefs and recesses of the same width and accurately facing one another (the assembly in FIG. 5). or whether these same reliefs and recesses are respectively staggered.

Tearing of the tabs such as 81 thus prepared is easy and thus produces crenelated torn edges for both the tab 81 and for the remaining portions 19 and 20, the tab 81 itself being bordered by knurled zones 23.

EXAMPLE 4

Similar conditions were applied, modifying the force on the set of knurled wheels, to caps based on aluminum with a skirt thickness of 0.13 mm, of two types and conditions:

1) aluminum with a 99.5% minimum content, in the annealed state, $H_B=20$;
2) aluminum alloy, type "3003" in accordance with A.A., with approximately 98% aluminum, 0.1% copper and 1.2% manganese, in a cold-hammered state, $H_B=55$.

In the first case, the same knurling wheels, with teeth that are not transversely inclined, were used with success. The tearable tabs of the two types of tearing line (at least 5 per type) are torn satisfactorily, without aggressivity on the part of the torn edges.

In the case of the harder alloy, it was necessary to proceed with an inclination of the teeth of each knurling wheel toward the tearing line. Two angles of inclination with respect to the axis of the cap were tested: 10° and 30°. Satisfaction was obtained in both cases for both types of tearing lines, as far as good tearing was concerned. It was noted that aggressivity in the part of the torn edges of the stump began in the case of the 30° angle; it is accordingly better to limit this angle to 25° in the case of a metal or alloy of equal hardness.

On this occasion, the excellent control in making a tearing line obtained with the technique of the tearing line by convergence (Example 3) is noted for thicknesses of 0.12 mm or less with an alloy having an HB hardness greater than 30.

Figure 7:
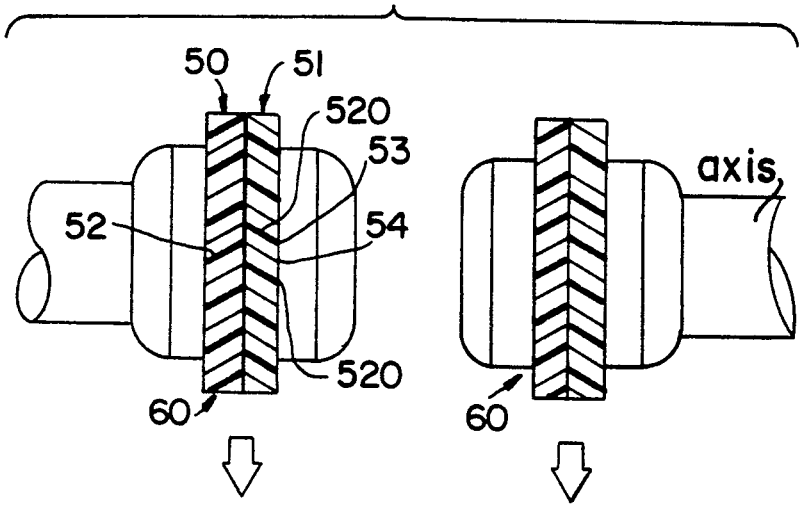
FIG. 7 shows two knurling wheels used to produce a fourth cap, in an elevation view.
Figure 8:
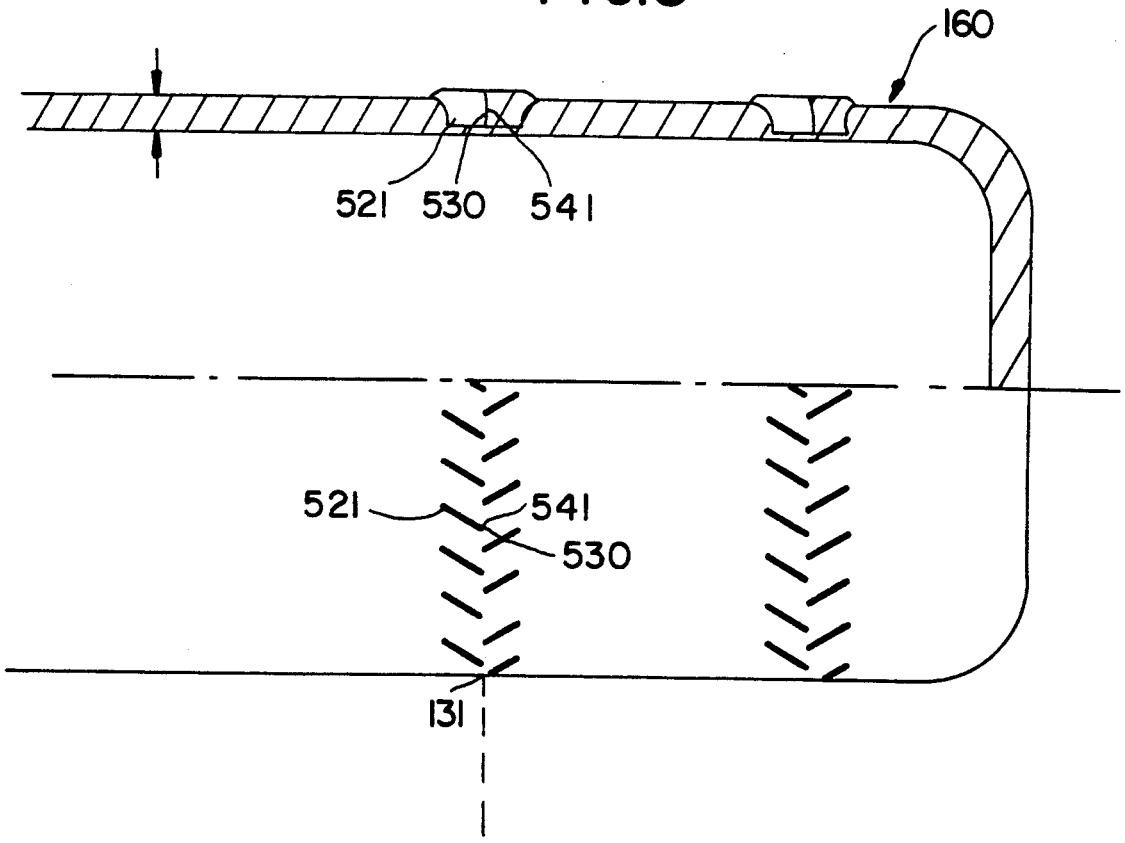
FIG. 8 shows this fourth cap, with one axial half-section and one external half-view.

EXAMPLE 5 (FIGS. 7 and 8)

Tests were made for caps 160 of annealed aluminum with at least 99.5% purity, having a skirt thickness of 0.09 mm, by the same technique for making the cutting line by convergence of two serrated knurling wheels, using knurling wheels 50 and 51 of the kind having a width or thickness of 0.5 mm that as before had teeth or reliefs 52 inclined by 25° with respect to the cutting line that they make, the reliefs of the two knurling wheels having a standard width of 0.2 mm and a pitch of 1 mm. The end 53 of each relief 52, at the plane of junction of the knurling wheels 50 and 51, is in the middle of a recess 54 of the other set of teeth, at half the distance of the reliefs 520 that bracket these recesses.

As FIG. 7 shows, the two knurling wheel sets 60 are identical but independent, making it possible to make one or even two tearing lines in one cap. Each includes the assembly of one knurling wheel 50 and one identical, inverted knurling wheel 51.

The conditions under which the knurling wheels are applied and the rotation for preparing a tearing line or a tearable tab are substantially the same as in the first example.

In FIG. 8, the recesses 521 can be seen that correspond to the reliefs 52 of the knurling wheels, here leaving a bottom thickness of 0.03 mm.

Along the cutting line 131, the end 530 of one recess 521 is bracketed by two nonincised portions such as 541 having a width along this cutting line of 0.3 mm.

In this embodiment, each end 530 of one recess 521 of each series is aligned with and included with play between two ends of recesses of the other succession, producing, for the pitch of the discontinuous cut 131 obtained, an incised portion 530 included between two reliefs or non-incised portions 541.

The ends of the recesses in each series can also be aligned with and overlap the ends of the recesses of the other series, forming a discontinuous cut having the same pitch as the pitch of the series.

The tests were performed on caps of various metals or alloys and of various thicknesses. They made is possible to confirm that the above adjustment gave good tearing results, without aggressiveity on the part of the torn edges, in the case of caps embodied as follows (skirt thickness given):

annealed aluminum, thickness 0.06 to 0.20 mm;

tin, thickness 0.1 to 0.2 mm;

lead plated with tin on both sides, thickness 0.1 to 0.25 mm;

multilayered aluminum/polyethylene or AAE/aluminum, thickness 0.08 to 0.2 mm, each of the aluminum layers having a thickness between 0.03 and 0.08 mm, and the central layer of polyethylene or of acrylic acid ethylene copolymer (AAE) having a thickness of 0.02 to 0.05 mm. In the case of such a complex, the best results are obtained by adjusting the cut in such a way that it begins to tear the inner, aluminum underlayer.

Tests for tearing of tabs, with variable orientations, have shown that the tearing obtained was guided in a highly replicable manner by the tearing lines according to the invention.

INDUSTRIAL APPLICATION

Tearable tabs for all metal caps, preventing injury from the tearing.

We claim:

1. A metal sealing or closure cap comprising a skirt having a thickness between 0.06 and 0.4 mm, and including two annular tearing lines defining therebetween a tearable tab, each said tearing line being defined by a cut having a bottom wall of thickness at most equal to 70% of the thickness of said skirt, and a series of alternating reliefs and recesses external to the cut, oriented oblique to the cut and directed toward the cut in the direction of tearing of the tab, said tab having no areas of recess and relief located therein.

2. The cap of claim 1, in which extensions of the reliefs (21) and recesses (15) of each said tearing line (13, 14; 130, 140) intersect in a V-shape oriented in the direction of tearing of said tab (80; 81).

3. The cap of claim 1, having a hardness $H_B > 30$, in which said reliefs (21) and recesses (15, 521) are located within a zone of width 0.4 mm to 1.5 mm adjacent each said tearing line (13, 14, 130, 140, 131).

4. The cap of claim 3 wherein said recesses are inclined by 10° to 25° with respect to the longitudinal axis of the cap, the thickness of the bottoms of the recesses decreasing toward said tearing line.

5. The cap of claim 1, in which the recesses have a known bottom thickness, and the bottom thickness (9) of each said cut is greater by 0.01 to 0.10 mm than the bottom thickness (10) of the recesses.

6. The cap of claim 1, of metal or an alloy of metal selected from the group consisting of lead, an alloy of lead, tin, an alloy of tin, aluminum, an alloy of aluminum, and aluminum in two layers joined together by polyethylene or AAE.

7. The cap of claim 1, in which each said recess has an end located in said tearing line or within 0.5 mm of said tearing line, and the thickness of said bottom wall is between 20 and 70% of the thickness of said skirt.

8. A metal sealing or closure cap comprising a skirt having a thickness between 0.06 and 0.4 mm, and including two annular tearing lines defining therebetween a tearable tab, each said tearing line being defined by two opposed series of alternating reliefs and recesses, each series oriented oblique to the tearing line, each said recess having one end thereof located on said tearing line opposite a corresponding relief, with areas of relief traversing the tearing line, such that each tearing line comprises alternating areas of relief and recess.

9. The cap of claim 1, in which said ends of the recesses (15) of each said series are aligned with an overlap the ends of the recesses of the other series, forming a discontinuous cut having a pitch the same as the pitch of said series.

10. The cap of claim 8, in which each end (530) of one recess (521) of each said series is aligned with and included with play between two ends of recesses of the other series, producing, for the pitch of the discontinuous cut (131) obtained an incised portion (530) included between two reliefs or nonincised portions (541).

11. The cap of claim 8, in which each recess and opposite relief forms a V-shape oriented in the direction of tearing.

* * * * *

UNITED STATES PATENT AND TRADEMARK OFFICE

CERTIFICATE OF CORRECTION

PATENT NO. : 5,222,616

DATED : June 29, 1993

INVENTOR(S) : Guy Druesne et al

It is certified that error appears in the above-identified patent and that said Letters Patent is hereby corrected as shown below:

Title page, item [57]
Abstract, line 3: change "ling" to --line--.
Column 8,
Claim 9, line 1: change "1" to --8--.

Signed and Sealed this

Fifth Day of April, 1994

*Attest:*

*Attesting Officer*

BRUCE LEHMAN

*Commissioner of Patents and Trademarks*